United States Patent [19]

Stravitz et al.

[11] Patent Number: 4,537,176

[45] Date of Patent: Aug. 27, 1985

[54] BLOW DART GAME INCLUDING HOLLOW TUBE AND DART WITH TARGET IMPACTING MEMBER AND SHOCK-ABSORBING PORTION

[75] Inventors: David M. Stravitz, New York, N.Y.; Gary D. Johnson, 151 Hudson St., New York, N.Y. 10013

[73] Assignee: Gary D. Johnson, New York, N.Y.

[21] Appl. No.: 458,962

[22] Filed: Jan. 18, 1983

[51] Int. Cl.[3] ..... F41B 1/02

[52] U.S. Cl. ..... 124/62; 124/41 R; 124/83; 273/416

[58] Field of Search ..... 124/62, 41 R, 80, 83; 273/416, 419, 420, 423; 446/177

[56] References Cited

U.S. PATENT DOCUMENTS

| | | | |
|---|---|---|---|
| 1,455,075 | 5/1923 | Chapman | 273/416 X |
| 3,124,119 | 3/1964 | Ayala | 124/62 |
| 3,388,696 | 6/1968 | Hoverath et al. | 124/41 R |
| 3,454,278 | 7/1969 | Cooper et al. | 446/177 X |
| 3,685,828 | 8/1972 | Getgey et al. | 124/62 X |

FOREIGN PATENT DOCUMENTS

| | | | |
|---|---|---|---|
| 523823 | 4/1956 | Canada | 446/177 |
| 102333 | 11/1965 | Denmark | 273/416 |
| 2702563 | 7/1978 | Fed. Rep. of Germany | 124/62 |
| 1194661 | 11/1959 | France | 273/419 |
| 646970 | 10/1962 | Italy | 273/419 |
| 1048738 | 11/1966 | United Kingdom | 124/62 |
| 2029711 | 3/1980 | United Kingdom | 273/416 |

*Primary Examiner*—Richard T. Stouffer

*Attorney, Agent, or Firm*—Frishauf, Holtz, Goodman & Woodward

[57] ABSTRACT

A blow dart game comprises a tube having an abutment therein for abutting against a dart which is inserted into the tube, thereby preventing the dart from coming out of the tube and being ingested or swallowed by a user. The abutment may be provided directly on the tube, or on a mouthpiece which is connected to the tube at one end of the tube. The darts have suction cups at the front ends thereof and a seal for providing a substantial air seal against the inner surface of the tube. The dart further has a shock absorbing section at the forward portion thereof to enhance its adherence to non-flat and/or non-perpendicular target surfaces. An impact member is provided in some of the darts to improve adherence to the target surface.

20 Claims, 28 Drawing Figures

FIG. 25
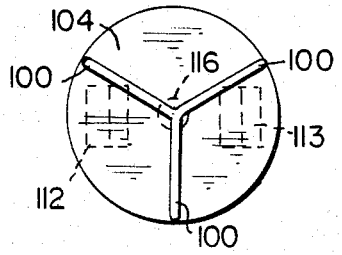
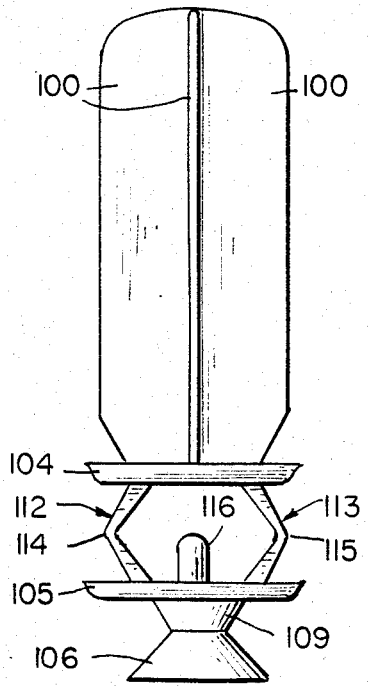
FIG. 24
FIG. 27
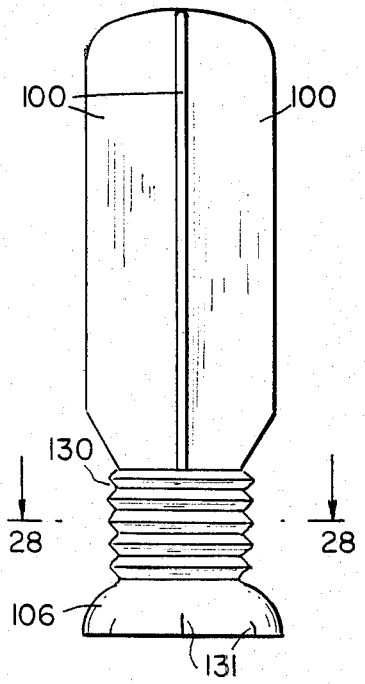
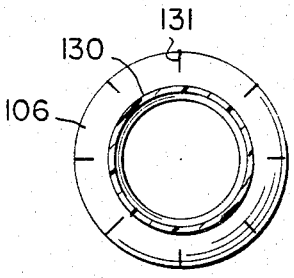
FIG. 28

BLOW DART GAME INCLUDING HOLLOW TUBE AND DART WITH TARGET IMPACTING MEMBER AND SHOCK-ABSORBING PORTION

BACKGROUND OF THE INVENTION

This invention relates to a blow dart game, and more particularly to a blow dart game having improved darts and an improved blow tube.

The object of the present invention is to provide a blow dart game having improved suction cup-type darts which will "stick" to a large variety of flat and/or curved surfaces when impinging such surfaces at perpendicular angles, as well as at angles other than perpendicular angles, and to provide an improved blow tube which, in combination with the improved darts, enhances the safety and sanitary aspects of use of the blow dart game.

SUMMARY OF THE INVENTION

According to the present invention, the improved darts comprise a front suction cup portion and a rear wing-like portion. Coupled intermediate the suction cup portion and the wing-like rear portion is a yieldable shock absorbing portion and an air seal portion which seals with the inner surface of the tube with which the dart of the blow tube game is used. The shock absorbing portion increases the effectiveness of the dart adhering to a surface against which it is impinged.

According to a further feature of the invention, the improved dart has an impact applying means which becomes effective after the shock absorbing means absorbs some of the impact shock of the dart impinging upon a surface. This further enhances "sticking" of the dart to the surface against which it impinges.

Still further, according to the present invention, a blow tube having a safety means for preventing ingestion of the dart by the user is provided. The blow tube has an internal abutment surface over which the dart is passable in one direction, but is substantially impassable in the other direction. According to a further feature of the invention, the blow tube comprises removable mouthpiece members to permit the game to be played by a plurality of players, all using the same tube, but each having his own individual mouthpiece. In a further preferred arrangement, the mouthpiece includes the internal abutment means to prevent sucking in or ingestion of the dart by the user, and/or may be permanently affixed to the tube to positively prevent ingestion of the darts by, for example, children.

BRIEF DESCRIPTION OF THE DRAWINGS

FIGS. 24 and 25 illustrate still another modified dart according to the present invention; FIGS. 27 and 28 illustrate another dart of the invention.

DETAILED DESCRIPTION

Figure 1:
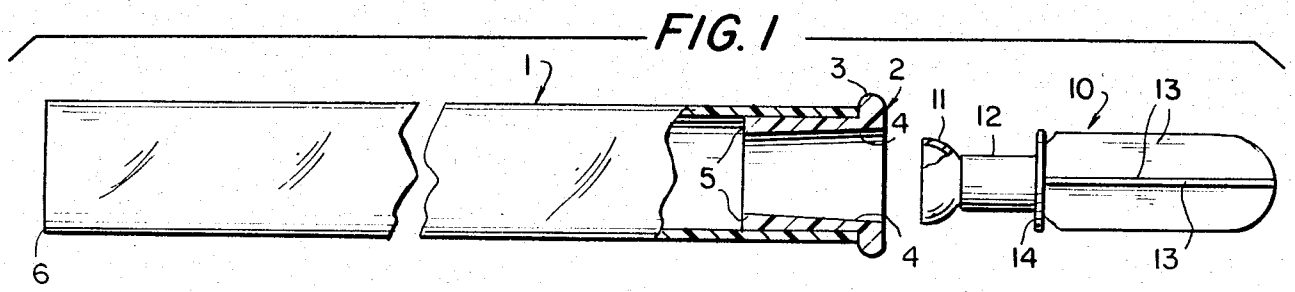
FIG. 1 is a side view, shown partially in section, of a blow tube and dart combination according to the present invention.

FIG. 1 illustrates a first embodiment of the invention comprising an elongated hollow tube 1 having a removable mouthpiece 2 slideably inserted into one end portion thereof. The mouthpiece 2 has a rounded outer edge 3 which is engageable with the mouth of the user so that the user may apply blowing force to the end of the tube via the mouthpiece 2. The mouthpiece further has an inclined inner surface 4 which terminates in an abutment surface 5. The mouthpiece 2 is removable from the end of the tube 1 so that it can be replaced for each player of the game, thereby providing a more sanitary device.

Figure 2:
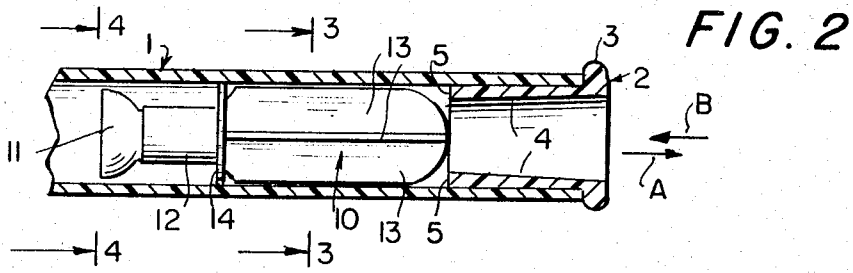
FIG. 2 shows, in section view, the arrangement of FIG. 1 with the dart inserted into the blow tube.
Figure 3:
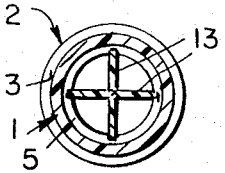
FIG. 3 is a cross-sectional view taken along line 3—3 in FIG. 2.
Figure 4:
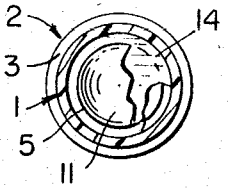
FIG. 4 is a cross-sectional view taken along line 4—4 in FIG. 2.
Figure 21:
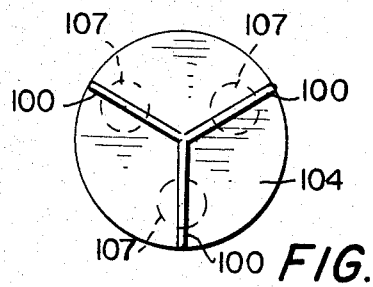
FIGS. 20 and 21 illustrate a modified dart according to the present invention.
Figure 20:
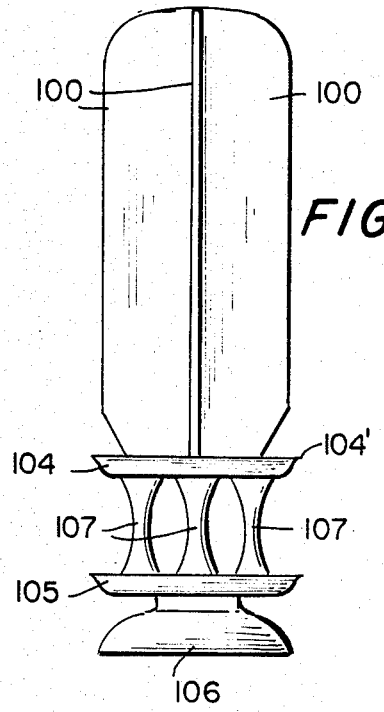

The dart 10 comprises a front suction cup portion 11, a shock absorbing portion 12 made of flexible and yieldable material and a wing-like air-guiding portion 13 comprised of four wing members 13, as best seen in FIG. 3. Intermediate the shock absorbing section 12 and the wing members 13 is a sealing member 14 which provides a relatively loose seal against the inner surface of the tube 1, as shown in FIG. 2. The seal member 14 is preferably disc-like and provides a sufficiently tight seal against the inner surface of tube 1 so that application of a blowing pressure to mouthpiece 2 will propel the dart along the inner surface of the tube 1 toward a target. The sealing member 14 may be loose fit relative to the inner surface of tube 1 (to reduce friction) so that a dart may be easily blown along and out of the tube 1 toward the target without applying excessive blowing forces by the user. The loose fit will reduce the potential dart flight distance due to air pressure leakage. The disc 14 may be "feathered" at its edges as shown in FIGS. 20 and 21. A tight fit gives more distance. The disc 14 may be slightly out-of-round to provide inherent leakage and to reduce frictional contact with the inner wall of the tube 1. The seal portion 14 should also be of flexible material so that it may have "give" and be easily inserted into the tube through the mouthpiece and through the inclined surface portion 4 of the mouthpiece 2 past the abutment portion 5. Similarly, the wing portions 13 are preferably of resilient or flexible material so thay they may also be flexibly or yieldably inserted through the inclined portion 4 of the mouthpiece 2 past the abutment surface 5. After insertion of the dart 10 through the mouthpiece portion 2 of the tube arrangement, the structure is as illustrated in FIG. 2. As can be seen, if the user inadvertently sucks inwardly on the mouthpiece 2 so as to create a force in the direction of the arrow A in FIG. 2, the dart will not move past the abutment surface 5 since the wing portions 13 of the dart will abut against abutment surface 5, thereby preventing the dart from moving rearwardly in the tube. If the wing surfaces are relatively small and fit easily past abutment surface 5, then the sealing portion 4 will engage abutment surface 5 to prevent the dart from moving rearwardly past abutment member 5 and out of the mouthpiece end of the tube. It is preferable that the wings lightly contact or are slightly spaced from the inner wall of tube 1 (as seen in FIG. 1) to guide the dart in its movement through tube 1. Upon application of a blowing force in the direction of the arrow B in FIG. 2, the dart 10 is forced to the left in FIG. 2 and out of the front end 6 (see FIG. 1) of the tube toward a target (not shown).

Figure 5:
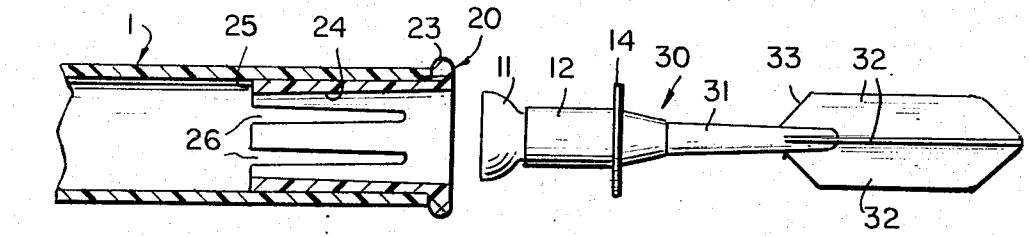
FIG. 5 illustrates a modified tube and dart arrangement according to the present invention.

FIG. 5 illustrates a modified arrangement of the present invention utilizing a modified mouthpiece 20 and a modified dart 30. The modified mouthpiece 20 comprises a lip or mouth engaging rounded portion 23 and an inclined inner surface 24. An abutment surface 25 is formed at the end of the inclined surface 24 which is interior of the tube 1. The mouthpiece has a plurality of slits 26 formed around the periphery thereof to permit same to be more easily inserted into the tube 1.

The modified dart 30 is similar in construction to the dart 10 of FIG. 1, and similar portions thereof are designated by the same reference numerals. The portion to the right of the sealing member 14 differs in FIG. 5 from the embodiment shown in FIG. 1. The dart 30 comprises an elongated rear section 31 having wings 32 which act as air guides. The wings 32 have inclined leading edges 33 to facilitate insertion of the wings 32 along the inclined surface 24 and over the abutment portion 25. The rear body portion 31 and wings 32 of the dart 30 may be made of rigid or flexible material. The portions 31 and 32 may be removable and replaceable. The shaft 31 may have slots to receive sheet-like (i.e., mylar) wings 32.

Figure 7:
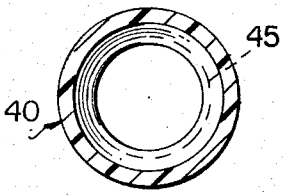
FIG. 7 is a cross-sectional view taken along line 7—7 in FIG. 6.
Figure 6:
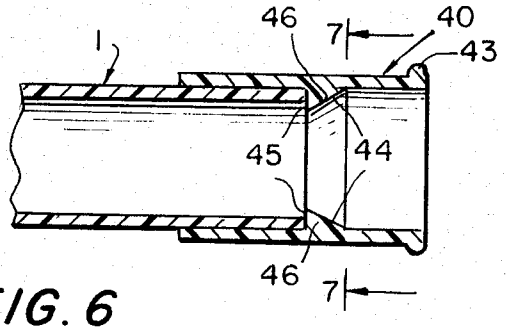
FIG. 6 illustrates a modified tube and mouthpiece arrangement according to the present invention.

FIG. 6 illustrates a modified mouthpiece 40 for use with a tube 1. FIG. 7 illustrates a cross-sectional view thereof. The mouthpiece 40 is removably insertable over the tube 1, or is permanently adhered to tube 1, and has an interior integrally formed inclined surface 44 which terminates in an abutment surface 45. The operation of the arrangement of FIGS. 6 and 7 is substantially identical with that of FIG. 1, except that the inclined surface portion 44 is of slightly different configuration than the inclined surface 4 of FIG. 1. Also, the abutment surface 45 is sufficiently large so as to extend over the tube 1 since the mouthpiece 44 in the FIG. 6 embodiment is insertable over the tube 1, whereas in FIG. 1 the mouthpiece is inserted interior of the tube 1.

Figure 9:
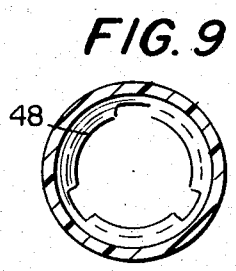
FIGS. 8–11 illustrate modified embodiments of the embodiment shown in FIGS. 6 and 7, the modified embodiments being shown in cross-sectional view only.
Figure 8:
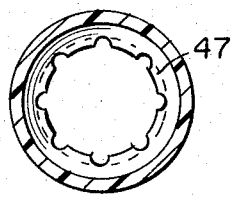
Figure 10:
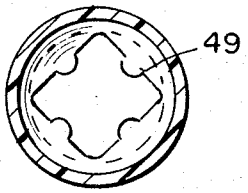

FIGS. 8, 9 and 10 illustrate modified arrangements of the abutment surface 45 illustrated in FIGS. 6 and 7. The cross-sectional features of the abutment surfaces 47–50 of FIGS. 8–11, respectively can be varied, as desired. Preferably, the arrangements of FIGS. 8–11 also include the inclined surface 44 of FIG. 6, such inclined surface not being shown in FIGS. 8–11. The angle of the inclined surface 44 shown in FIG. 6 is merely given by way of example, and could vary, as desired. A very long slope for inclined surface 44 could be provided, such as shown in FIGS. 1 and 5.

Figure 12:
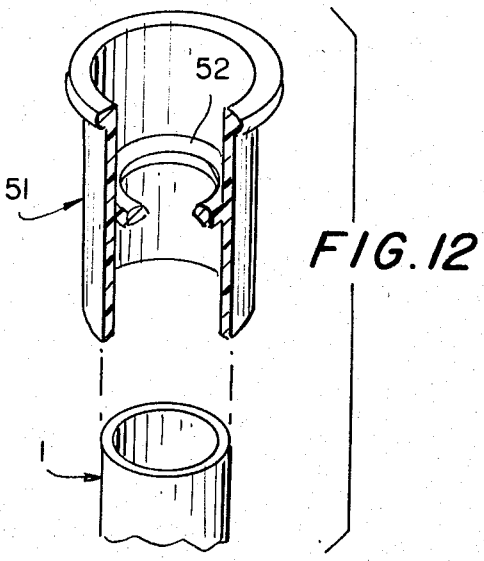
FIG. 12 is a partially sectional perspective view of the tube and mouthpiece arrangement of the present invention showing how the mouthpiece is inserted onto the tube end.
Figure 11:
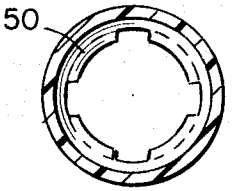

FIG. 12 illustrates a further modified arrangement wherein the mouthpiece 51 has a generally circular abutment member 52 formed therein either integrally or attached to mouthpiece 51. The mouthpiece 51 slides over the tube 1 and the abutment member 52 extends over the upper edge surface of the tube 1 to provide a protective abutment, such as abutment 45 in FIG. 6. The circular ring-shaped abutment member 52 can have configurations on its radially inner surface portions similar to those illustrated in FIGS. 8–11, as desired.

Figure 13:
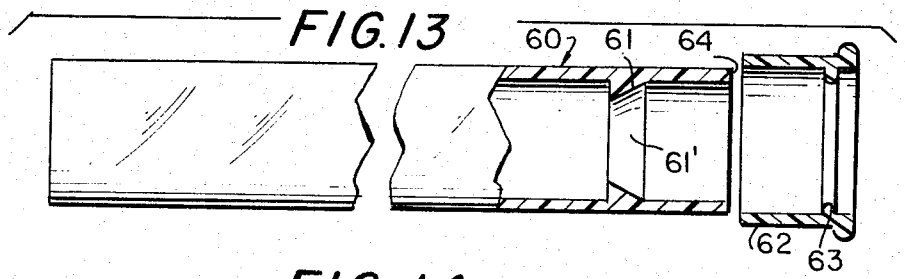
FIG. 13 illustrates a tube with an integrally formed abutment section at an intermediate portion thereof.

FIG. 13 illustrates a tube 60 having an abutment member 61 (similar to abutment 46 of FIG. 6) integrally formed and projecting inwardly from an inner surface of tube 60. An inclined surface 61' is provided on abutment member 61 so as to act as a lead-in to facilitate insertion of a dart into the tube 60. In the arrangement of FIG. 13, a separate mouthpiece may or may not be provided, as desired. In this arrangement, it is not necessary that the mouthpiece include an abutment member. The mouthpiece may merely be a simple tubular member 62, such as shown in FIG. 13. The tubular member 62 may have an internal stop member 63 thereon for abutting against the end walls 64 of tube 60 when the mouthpiece 62 is inserted over the tube 60.

Figure 14:
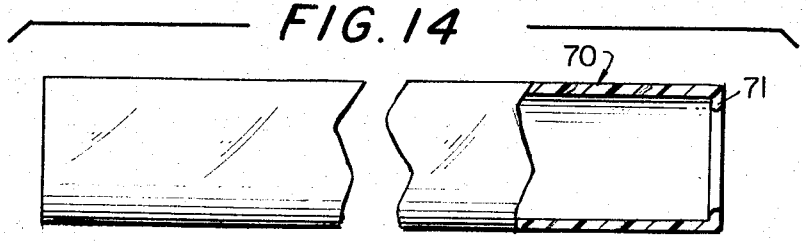
FIG. 14 shows a tube having an integrally formed abutment section at an end portion thereof.

FIG. 14 illustrates an embodiment similar to that of FIG. 13, except that the abutment member 71 is located at the end of the tube 70. A mouthpiece similar to mouthpiece 62 can be used with the FIG. 14 embodiment. In this case, the abutment member 63 of the mouthpiece 62 is preferably located more to the left than as seen in FIG. 13 so that the end lip-engaging portion of the mouthpiece 62 is further away from the abutment member 71 of the tube 70 to improve anti-inhalation precautions. Abutment 71 may be wedge-shaped, like abutment 61 in FIG. 13.

Figure 15:
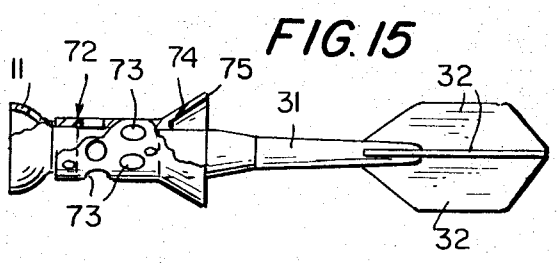
FIG. 15 illustrates a modified dart according to the present invention.

FIG. 15 illustrates a modified dart similar to the dart 30 of FIG. 5 having a shock absorbing front end portion 72 and a sealing member 74. Portions of FIG. 15 similar to those of FIG. 5 are given the same reference numerals for ease of description. The dart of FIG. 15, as well as the other darts disclosed herein, may be integrally molded in one piece or may be assembled from individual parts. In FIG. 15, the shock absorbing portion 72 is a generally cylindrical flexible plastic member having a plurality of apertures 73 formed therein. The apertures 73 are preferably formed around the complete peripheral portion of shock absorbing member 72 so as to render the shock absorbing characteristics substantially omnidirectional to improve adherence of the dart to a target surface over a large range of angular impact directions. The suction member 11 is mounted interior of the tubular member 72 either integrally or being adhered thereto by means of adhesive, for example. The sealing portion 74 is a cup-shaped inclined member extending rearwardly of the dart to facilitate insertion of the sealing cup-shaped member 74 past the various abutment members of the tubes and/or mouthpieces. The cup-shaped inclined member improves the seal with the inner wall of the tube and facilitates passing over abutment. It also improves the aerodynamics of the dart. If the cup-shaped member 74 is of sufficient flexibility, it will "inflate" slightly upon application of blowing pressure, further improving the seal wth the inner surface of the tube. The end surface 75 abuts against the abutment members of the tubes and/or mouthpieces to prevent the dart from being sucked backwardly in the tube after insertion. Also, the wing members 32 are preferably of resilient material and are dimensioned so as to yieldingly pass the various abutment members and prevent sucking in of the dart after the dart is inserted into the tube ready for use. The cup-shaped member 74 may be integrally formed with the shock absorbing cylindrical member 72, as illustrated in FIG. 15, or it may be separately formed and attached to the dart structure during manufacture. Still further, the location of the cup-shaped member 74 can be varied either forwardly or rearwardly of the illustrated location on the dart. Member 74 is preferably located at the front portion of the dart.

Figure 16:
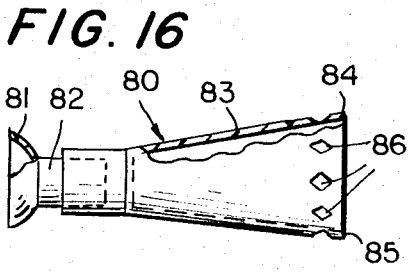
FIG. 16 illustrates yet another modified dart according to the present invention.

FIG. 16 illustrates a further modified dart 80. The dart 80 is a low mass, low kinetic energy dart. This dart will travel at high speed, but will have a lesser impact energy than the aforementioned darts due to its low mass, improving safety. Dart 80 comprises a suction cup member 81 at the front end thereof, an intermediate shock absorbing portion 82 preferably made of flexible and resilient material and a cone-shaped hollow portion 83 extending rearwardly from the intermediate portion 82. The cone-shaped portion has outwardly flaring rear end portions 84 which act as a sealing member against the inner surface of the tubes. Apertures 86 are provided at the end portions of the cone-shaped member 83. The hollow cone-shaped portion 83 is made of flexible material so that it can be yieldingly inserted into the tube from the mouthpiece end over the various inclined surfaces and/or abutment members. Cone-shaped portion 83 may be a solid foamed plastic material, in which case the apertures 86 are eliminated. Such a dart is also a low mass, low kinetic energy dart. The end surfaces 85 of the cone-shaped member 83 of FIG. 16, or the end surfaces of the foamed plastic cone-shaped member (not shown), will abut against the respective abutment members of the tubes and/or mouthpieces to prevent sucking in of the dart by the user.

The sizes of the apertures 86 in the hollow cone member 83 of FIG. 16 will determine the amount of propulsion force applied to the dart by the user since the combined total area of the aperture 86 will define a predetermined amount of "leakage" built into the dart. This leakage will effect the obtainable distance of propulsion.

Figure 17:
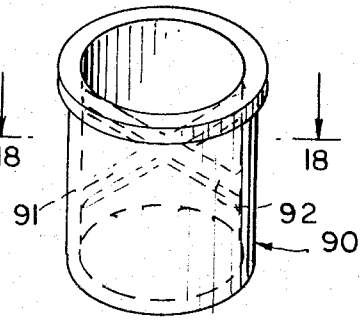
FIG. 17 illustrates a modified mouthpiece arrangement with an integrally formed abutment member.

FIG. 17 illustrates a modified mouthpiece 90 having a crossbar configuration 91, 92 interior thereof for serving as an abutment member to prevent sucking in of the dart by the user. In this arrangement, it is necessary to either insert the dart from the end remote from the mouthpiece 90, or to remove the mouthpiece 90 prior to inserting the dart into the tube, and then replacing the mouthpiece 90 on the tube after insertion of the dart. Removal of the mouthpiece 90 is the preferable method of insertion of the dart.

The arrangement of FIG. 17 (shown in cross-section in FIG. 18) is a very positive preventative means for preventing the dart from being inadvertently sucked into the mouth of the user. The cross members 91, 92 can be integrally formed with the mouthpiece member 90, for example by integral molding, or may be adhered to the cylindrical mouthpiece 90.

Figure 19:
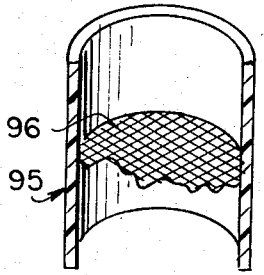
FIG. 19 illustrates a further modified mouthpiece with an abutment member according to the invention.

FIG. 19 illustrates a modified mouthpiece arrangement 95 having a screen or mesh-like abutment member 96 which prevents sucking in of the dart by the user. Use of the arrangement of FIG. 19 is similar to that of FIG. 17.

Figure 18:
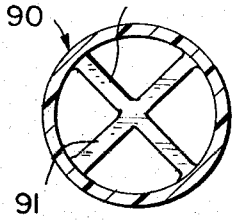
FIG. 18 is a cross-sectional view along line 18—18 in FIG. 17.

The arrangements of FIGS. 17–19 can be provided at the end of the tube directly, without the intermediary of a mouthpiece. In this instance, the reference numerals 90, 95 in FIGS. 17 and 19, respectively, designate end portions of the respective tubes per se, rather than of respective mouthpieces. The screen member 96 may be integrally formed with the member 95, for example by molding, or may be attached after fabrication of the cylindrical member 95, as desired.

FIGS. 20 and 21 illustrate a further modified dart according to the present invention. The dart of FIGS. 20 and 21 comprise three wing-portions 100 and a sealing portion 104 which functions similarly to the sealing portion 14 of the darts illustrated in FIGS. 1–5. The dart of FIGS. 20 and 21 further comprise a front member 105 (which may also be dimensioned substantially the same diameter as sealing portion 104 to also serve as an air seal, as shown in FIG. 20) with a suction cup 106 extending from the front end thereof. By providing a double seal by elements 104 and 105, improved sealing and directional stability through the tube are obtained. If only a single seal is desired, element 104 or 105 may be reduced in diameter. Extending between front member 105 and sealing member 104 are three resilient columnar members 107 which preferably have tapered central portions to improve the multidirectional shock absorbing resiliency thereof, as illustrated in FIG. 20. Columnar members 107 are preferably solid, but may be hollow. The complete dart of FIGS. 20 and 21 is moldable of resilient plastic material and the columnar members 107 comprise a multidirectional shock absorbing portion which enhances the operability of the suction cup type dart and improves adhering to non-flat and non-perpendicular surfaces. Any number of columnar members 107 can be provided, three being shown in the drawing merely for the sake of explanation. Preferably, the members 107 are distributed substantially evenly around the dart so as to provide an omnidirectional characteristic for the dart. The ends 104', 105' of members 104, 105 are preferably "feathered" as shown in FIG. 20 to improve sealing and reduce friction.

Figure 23:
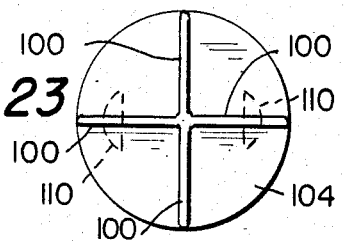
FIGS. 22 and 23 illustrate yet another modified dart according to the present invention.
Figure 22:
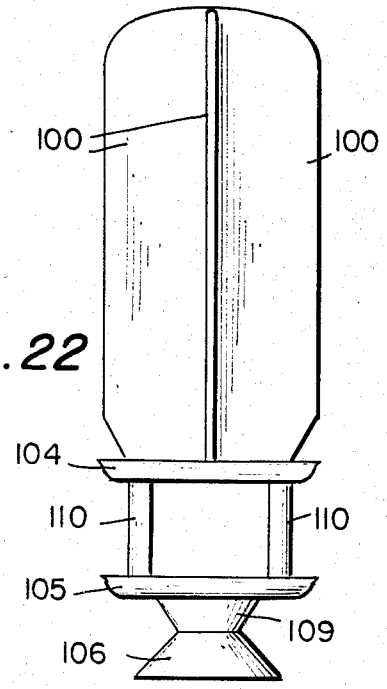

FIGS. 22 and 23 illustrate a further dart of the invention which is similar to the dart of FIGS. 20 and 21, except for the shock absorbing portion and suction cup portion thereof. Similar portions in FIGS. 22 and 23 to those in FIGS. 20 and 21 are given the same reference numerals for ease of description. The dart of FIG. 22 comprises two columnar portions 110 (hollow or solid) extending between sealing member 104 and front member 105 (which may also be a sealing member). This arrangement is easier to mold than the arrangement of FIG. 20. While the dart characteristics are not as omnidirectional as the dart of FIG. 20, sufficient flexibility and shock absorbing characteristics are provided by the columnar members 110 that satisfactory operation is achieved. The suction cup 106 of FIG. 22 is connected to front member 105 via an intermediate member 109 (preferably solid, but could be hollow) which serves substantially as a "pivot" to improve adherence to surfaces. The dart of FIGS. 22 and 23 has four wings 100 to improve directional stability in flight.

FIGS. 24 and 25 illustrate a further dart of the invention having not only shock absorbing members between sealing member 104 and front member 105 (which could also serve as a seal), but also an impact member 116 which creates an impact only after a predetermined amount of the impact shock is absorbed by the shock absorbing members. Due to the provision of the impact member 116, better transfer to kinetic energy is obtained. The dart of FIGS. 24 and 25 has proved to be superior in adhering to surfaces which are non-perpendicular and/or of irregular shape and which are at an angle to the direction of flight of the dart. The dart of FIGS. 24 and 25 also preferably has the "pivot" portion 109 behind the suction cup 106, as seen also in FIGS. 22 and 23.

As seen in FIGS. 24 and 25, the dart comprises shock absorbing members 112, 113 which are thicker at their upper and lower end portions (where they meet sealing member 104 and front member 105, which could be a seal, respectively) and which are of reduced thickness at their substantially central portions 114, 115, respectively. The shock absorbing members 112, 113 are also angularly formed and form respective peaks at reduced thickness portions 114, 115 so that portions 114, 115 serve substantially as a "hinge" to at least partially absorb shock when the dart impinges upon a target. Located in the central portion of the dart, behind the suction cup 106, and forward of the sealing member 104, is an impact member 116 which is shown in FIGS. 24 and 25 as being a substantially circular columnar member. Impact member 116 is preferably integrally molded with the front portion 105 of the dart. However, it could alternatively be molded integral with the sealing member 104 and extend downwardly, spaced from the front member 105. Still further, the circular columnar shape of impact member 116 is given only by way of example, it being clear that it may take various other cross-sectional shapes, as desired. During use, when the dart of FIGS. 24 and 25 impacts a surface with its suction cup 106, the shock absorbing members 112, 113 yield in a flexible manner and substantially articulate about reduced thickness portions 114, 115. During this movement, shock is absorbed until the impact member 116 impacts against sealing member 104. When this happens, a strong force, due to the inertia of the rear portion of the dart which comprises the wing members 100, is applied to the suction cup to aid in the suction cup 106 adhering to the target surface. The shock absorbing members 112, 113 and the impact member 116 cooperate to reduce the amount of recoil in the dart, after impact. This improves the action of the dart sticking to the target surface. Without the recoil prevention, it has been found that the dart very often does not stick to the target surface.

The darts of FIGS. 20–23 may be provided with an impact member 116, as shown in FIG. 24, and the dart of FIG. 15 may have an impact member 116 interior of resilient cylindrical member 72.

FIG. 27 shows a modified dart where the suction cup 106 is dimensioned to serve as the sealing member. This dart has a hollow bellows 130 which functions as the shock absorber, and as it collapses, serves as an impact member. Bellows 130 also serves as a "pivoting" member. The bellows 130 may be used in the other dart embodiments in place of the various shock absorbers shown therein. The impacting member 116 can be provided internally of bellows 130.

FIGS. 27 and 28 show a suction cup 106 with scoring marks 131 (raised projections-molded in) thereon. When the suction cup adhers to a target on a line, the marks 131 are used, for example to determine if the suction cup is more than half way over a scoring line.

It is emphasized that all of the darts of the present invention have some type of shock absorbing member rearwardly of the suction cup and forwardly of the wing portions thereof. These shock absorbing members, which are preferably made of resilient, yieldable, flexible plastic material, enable high impact of the dart to be achieved, but reduce the amount of recoil which tends to pull the dart off the surface of the target.

This improves the adherence of the darts onto the target surface, especially when the target surface is irregular in shape and/or it is at an angle to the direction of flight of the dart.

Figure 26:
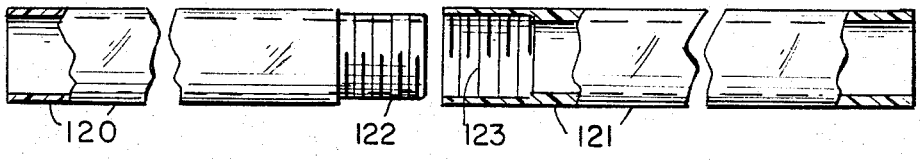
FIG. 26 illustrates a two-piece tube of the present invention.

FIG. 26 shows a two-piece tube construction comprising tubes 120, 121 screwed together by threaded portions 122, 123. A mouthpiece with an abutment can be provided at one end of the connected structure, or an abutment for darts can be formed at one end of one tube section.

The darts may have noise making elements thereon to make a noise when they are in flight, thus improving user interest. The wings can be made spirally formed to cause the darts to twist or spin about their longitudinal axis in flight. The darts could also be made of, or painted with, "glow-in-the-dark" material to further improve enjoyment of use.

Preferably, the complete dart is integrally molded of plastic material. The darts illustrated in FIGS. 20–25 are particularly suited to such one-piece integral molding, as are the darts of FIGS. 1–5. The darts of FIGS. 15 and 16 are more difficult to integrally mold since they require cam action molds, but they also may be integrally molded of one piece in plastic material. The darts may be made of polyvinyl chloride, vinyl, soft polypropylene, soft polyethylene, rubber or like materials, or of sheet-like mylar.

The mouthpiece and tube may be made of acrylic, styrene, butrate, ABS, polycarbonate, polypropylene or like materials. Preferably, the tube is about two feet long and about one inch in diameter. The tube and mouthpiece may also be made of other materials such as metal (i.e. stainless steel). The mouthpiece may be made of soft flexible materials such as the above-mentioned soft plastic materials for the dart.

We claim:

1. A blow dart game comprising:

an elongated hollow tubular member which is open at both ends;

abutment means spaced inwardly from an end of said elongated tubular member and comprising an abutment internally of said elongated tubular member;

a dart having a front target impacting suction cup member, an air guiding section extending rearwardly of said target impacting member, and a resiliently yieldable shock-absorbing portion extending rearwardly of said target impacting member, said shock absorbing portion comprising at least two resilient, spaced apart members coupling said front target impacting member with said air guiding section of said dart; and sealing means on said dart for providing a substantial seal interior of said elongated tubular member when said dart is placed interior of said elongated tubular member, said sealing means being rearward of said target impacting suction cup member, said suction cup member being smaller in diameter than said sealing means so that said suction cup member passes substantially freely through said tubular member;

said abutment means being abuttable against at least a portion of said dart when said dart is interior of said elongated tubular member to prevent said dart from inadvertently coming out of the end of said elongated tubular member at which said abutment means is located.

2. The blow dart game of claim 1, wherein said elongated tubular member comprises a main tubular section and a mouthpiece section on said main tubular section.

3. The blow dart game of claim 2, wherein said mouthpiece section is removably coupled to said main tubular section.

4. The blow dart game of claim 3, wherein said abutment means is formed interior of said mouthpiece section.

5. The blow dart game of claim 2, wherein said abutment means is formed interior of said mouthpiece section.

6. The blow dart game of claim 1, wherein said shock-absorbing portion of said dart comprises at least two generally V-shaped resiliently yieldable members coupling said front target impacting member with said air guiding section of said dart, the apex of said V-shaped portion being intermediate said front target impacting member and said air guiding section of said dart.

7. The blow dart game of claim 6, further comprising an impact member extending from one of said front target impacting member and a rear portion of said dart, and terminating short of the other of said front member and rear portion of said dart, for impacting said other of said front member and rear portion of said dart after a predetermined amount of impact has been absorbed by said shock-absorbing portion.

8. The blow dart game of claim 1, further comprising an impact member extending from one of said front target impacting member and a rear portion of said dart, and terminating short of the other of said front member and rear portion of said dart, for impacting said other of said front member and rear portion of said dart after a predetermined amount of impact has been absorbed by said shock-absorbing portion.

9. The blow dart game of claim 1, comprising:

a mouthpiece section at one end of said elongated tubular member; and said abutment means being formed on at least one of said elongated tubular member and mouthpiece section for engaging a dart upon insertion of said dart into said elongated tubular member to prevent said dart from inadvertently coming out of said one end of said elongated tubular member.

10. The blow dart game of claim 9, wherein said mouthpiece is removably engageable with said one end of said elongated tubular member.

11. The blow dart game of claim 10, wherein said abutment means is formed on the interior of said mouthpiece section.

12. The blow dart game of claim 10, wherein said abutment means is formed on the interior of said tubular member.

13. The blow dart game of claim 9, wherein said abutment means is formed on the interior of said mouthpiece section.

14. The blow dart game of claim 9, wherein said abutment means is formed on the interior of said tubular member.

15. The blow dart game of claim 9, wherein said tubular member comprises first and second sections removably coupled together.

16. The blow dart game of claim 1, wherein said tubular member comprises first and second sections removably coupled together.

17. A blow dart game comprising:

an elongated hollow tubular member which is open at both ends;

abutment means extending inwardly of said elongated tubular member and comprising an abutment internally of said elongated tubular member;

a dart having a front target impacting member, an air guiding section extending rearwardly of said target impacting member, and a resiliently yieldable shock-absorbing portion extending rearwardly of said target impacting member, said shock-absorbing portion comprising at least two resilient, spaced-apart members coupling said front target impacting member with said air guiding section of said dart; and sealing means on said dart for providing a substantial seal interior of said elongated tubular member when said dart is placed interior of said elongated tubular member;

said abutment means being abuttable against at least a portion of said dart when said dart is interior of said elongated tubular member to pevent said dart from inadvertently coming out of the end of said elongated tubular member at which said abutment means is located.

18. The blow dart game of claim 17, further comprising an impact member extending from one of said front target impacting member and a rear portion of said dart, and terminating short of the other of said front member and rear portion of said dart, for impacting said other of said front member and rear portion of said dart after a predetermined amount of impact has been absorbed by said shock-absorbing portion.

19. A blow dart game comprising:

an elongated hollow tubular member which is open at both ends;

abutment means extending inwardly of said elongated tubular member and comprising an abutment internally of said elongated tubular member;

a dart having a front target impacting member, an air guiding section extending rearwardly of said target impacting member, and a resiliently yieldable shock-absorbing portion extending rearwardly of said target impacting member, said shock-absorbing portion comprising at least two generally V-shaped resiliently yieldable members coupling said front target impacting member with said air guiding section of said dart, the apexes of said V-shaped members being intermediate said front target impacting member and said air guiding section of said dart; and sealing means on said dart for providing a substantial seal interior of said elongated tubular member when said dart is placed interior of said elongated tubular member;

said abutment means being abuttable against at least a portion of said dart when said dart is interior of said elongated tubular member to prevent said dart from inadvertently coming out of the end of said elongated tubular member at which said abutment means is located.

20. The blow dart game of claim 19, further comprising an impact member extending from one of said front target impacting member and a rear portion of said dart, and terminating short of the other of said front member and rear portion of said dart, for impacting said other of said front member and rear portion of said dart after a predetermined amount of impact has been absorbed by said shock-absorbing portion.

* * * * *